US009058923B2

(12) United States Patent
Inui

(10) Patent No.: US 9,058,923 B2
(45) Date of Patent: Jun. 16, 2015

(54) ELECTRONIC COMPONENT AND MANUFACTURING METHOD THEREOF

(71) Applicant: MURATA MANUFACTURING CO., LTD., Kyoto (JP)

(72) Inventor: Masaki Inui, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 15 days.

(21) Appl. No.: 13/684,328

(22) Filed: Nov. 23, 2012

(65) Prior Publication Data

US 2013/0135075 A1 May 30, 2013

(30) Foreign Application Priority Data

Nov. 25, 2011 (JP) ..... 2011-256901

(51) Int. Cl.

| | |
|---|---|
| ***H01F 5/00*** | (2006.01) |
| ***H01F 27/28*** | (2006.01) |
| ***H01F 41/04*** | (2006.01) |

(52) U.S. Cl.

CPC ..... *H01F 5/003* (2013.01); *H01F 41/041* (2013.01); *Y10T 29/4902* (2015.01)

(58) Field of Classification Search

USPC ..... 336/200, 232

See application file for complete search history.

(56) References Cited

U.S. PATENT DOCUMENTS

| | | | | |
|---|---|---|---|---|
| 4,689,594 | A * | 8/1987 | Kawabata et al. | 336/200 |
| 6,675,462 | B1 * | 1/2004 | Takahashi | 29/602.1 |
| 2008/0246579 | A1 * | 10/2008 | Mizuno et al. | 336/205 |
| 2011/0193448 | A1 * | 8/2011 | Saruban et al. | 336/200 |

FOREIGN PATENT DOCUMENTS

| | | | |
|---|---|---|---|
| JP | S61-148622 | A | 7/1986 |
| JP | H04-072872 | U | 6/1992 |
| JP | H06-031113 | U | 4/1994 |
| JP | H10-64014 | A | 3/1998 |
| JP | 10-199729 | A | 7/1998 |
| JP | 2005-268455 | A | 9/2005 |
| JP | 2009081189 | A * | 4/2009 |
| JP | 2010-192643 | A | 9/2010 |
| JP | 2011-114627 | A | 6/2011 |

OTHER PUBLICATIONS

An Office Action; "Notification of Reasons for Refusal," issued by the Japanese Patent Office on Oct. 22, 2013, which corresponds to Japanese Patent Application No. 2011-256901 and is related to U.S. Appl. No. 13/684,328; with English translation.

* cited by examiner

*Primary Examiner* — Tsz Chan

(74) *Attorney, Agent, or Firm* — Studebaker & Brackett PC

(57) ABSTRACT

A stack is configured by stacking magnetic layers and non-magnetic layers, and has a rectangular-parallelepiped shape. A coil is provided in the stack, and has a coil axis that is substantially parallel to a stacking direction of the stack. The stacking direction and the coil axis are not parallel to sides that configure the stack.

12 Claims, 6 Drawing Sheets

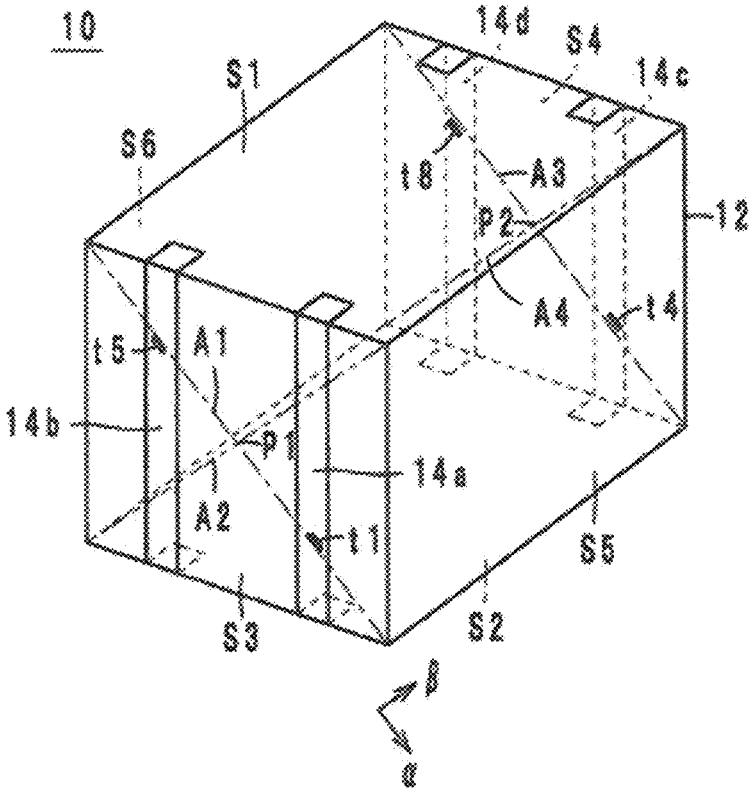
FIG.1
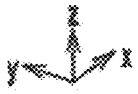

ELECTRONIC COMPONENT AND MANUFACTURING METHOD THEREOF

CROSS REFERENCE TO RELATED APPLICATIONS

The present application claims priority to Japanese Patent Application No. 2011-256901 filed on Nov. 25, 2011, the entire contents of this application being incorporated herein by reference in their entirety.

TECHNICAL FIELD

The technical field relates to electronic components and manufacturing methods thereof, and more particularly relates to an electronic component embedded with a coil and to a manufacturing method thereof.

BACKGROUND

As an invention relating to a conventional electronic component, for example, a laminate electronic component described in Japanese Unexamined Patent Application Publication No. 2005-268455 is known. The electronic component described in Japanese Unexamined Patent Application Publication No. 2005-268455 includes a rectangular-parallelepiped chip body configured by stacking rectangular sheets. The electronic component also includes two coils that configure a choke coil. The two coils are configured with respective spiral conductive patterns formed on the sheets.

Meanwhile, an increase in diameter of a coil without an increase in element size is generally requested for the electronic component embedded with a coil.

SUMMARY

The present disclosure provides an electronic component in which the diameter of a coil can be increased without an increase in element size, and a manufacturing method thereof.

An electronic component according to an aspect of the present disclosure includes a rectangular-parallelepiped stack configured by stacking a plurality of insulating layers, and a first coil in the stack having a coil axis substantially parallel to a stacking direction of the stack. The stacking direction and the coil axis are not parallel to sides that configure the stack.

In another aspect of the present disclosure, a manufacturing method of an electronic component includes steps of fabricating a mother stack that is configured by stacking a plurality of mother insulating layers and is embedded with a first coil group including a plurality of first coils arranged in rows and columns in which a row direction is orthogonal to a column direction, cutting the mother stack in an area between the rows of the plurality of first coils along the row direction, in a direction orthogonal to a principal plane of the mother stack, cutting the mother stack in an area between the columns of the plurality of first coils along the column direction, in a first direction inclined with respect to the principal plane of the mother stack, and cutting the mother stack in an area between the columns of the plurality of first coils along the column direction, in a second direction orthogonal to the first direction.

BRIEF DESCRIPTION OF THE DRAWINGS

FIG. 1 is an external perspective view of an electronic component according to an exemplary embodiment.

DETAILED DESCRIPTION

An electronic component and a manufacturing method thereof according to exemplary embodiments will now be described with reference to the drawings.

Figure 2:
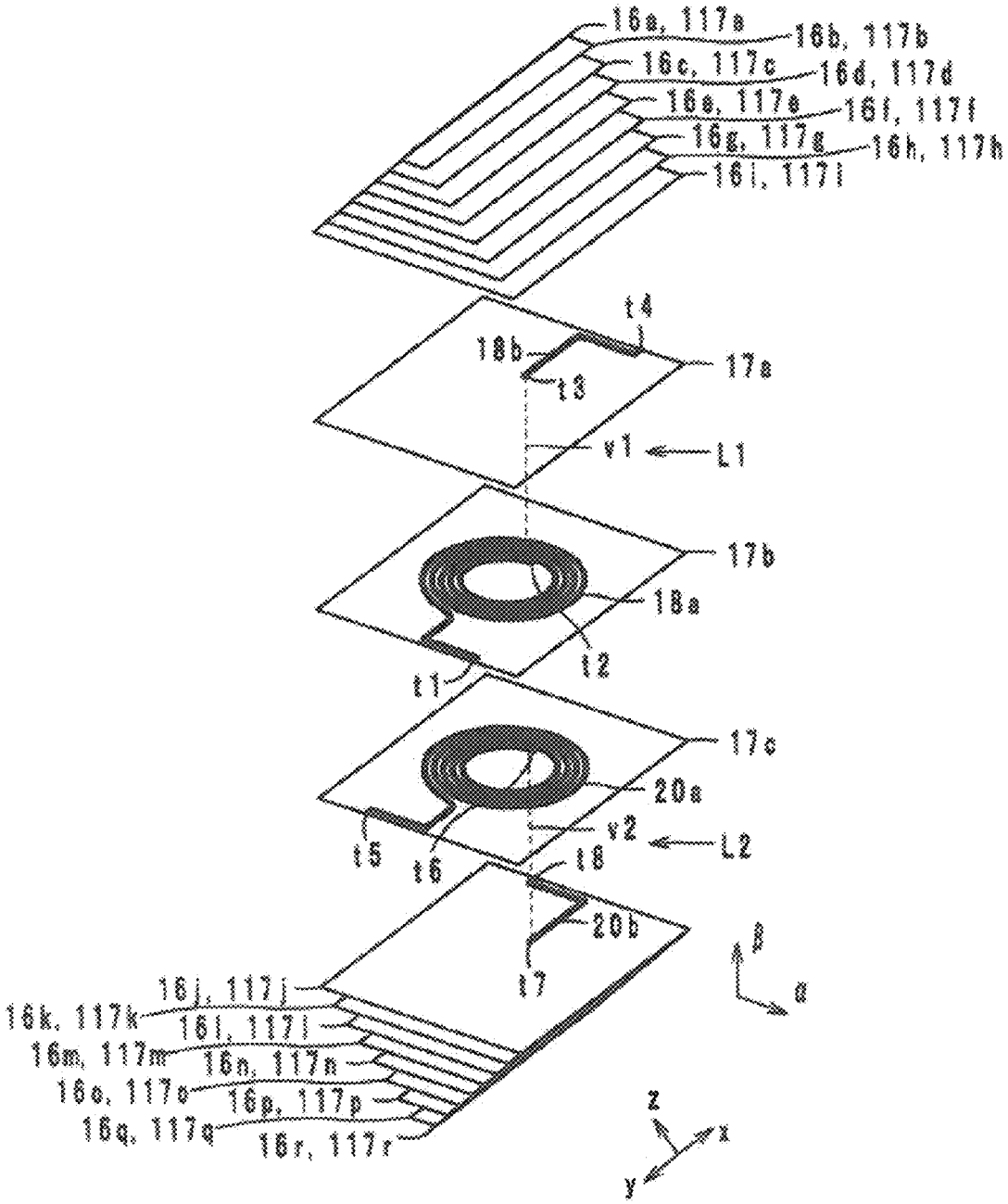
FIG. 2 is an exploded perspective view of a stack of the electronic component shown in FIG. 1.

A configuration of an exemplary electronic component is described first with reference to the drawings. FIG. 1 is an external perspective view of an electronic component 10. FIG. 2 is an exploded perspective view of a stack 12 of the electronic component 10. In the following description, the up-down direction of FIG. 1 is defined as a z-axis direction. Respective directions in which two sides of the stack 12 extend in plan view in the z-axis direction define an x-axis direction and a y-axis direction. The x-axis direction, y-axis direction, and z-axis direction are orthogonal to one another. FIG. 2 is a view when the stack 12 in FIG. 1 is rotated counterclockwise by 45° around the x-axis.

The electronic component 10 is a chip electronic component embedded with a common mode choke coil. As shown in FIGS. 1 and 2, the electronic component 10 includes the stack 12, outer electrodes 14 (14*a* to 14*d*), and coils L1 and L2.

As shown in FIG. 1, the stack 12 has a rectangular-parallelepiped shape and includes an upper surface S1, a lower surface S2, and side surfaces S3 to S6. The upper surface S1 is a surface at the positive side in the z-axis direction of the stack 12. The lower surface S2 is a surface at the negative side in the z-axis direction of the stack 12, and is opposed to the upper surface S1. The side surface S3 is a surface at the negative side in the x-axis direction of the stack 12. The side surface S4 is a surface at the positive side in the x-axis direction of the stack 12, and is opposed to the side surface S3. The side surface S5 is a surface at the negative side in the y-axis direction of the stack 12. The side surface S6 is a surface at the positive side in the y-axis direction of the stack 12, and is opposed to the side surface S5. In this embodiment, the side surfaces S3 and S4 each have a square shape. Also, it is assumed that the diagonals of the side surface S3 are diagonals A1 and A2, and the diagonals of the side surface S4 are diagonals A3 and A4, respectively.

Also, as shown in FIG. 2, the stack 12 is configured by stacking a plurality of magnetic layers 16 (16*a* to 16*i*), which are insulating layers; non-magnetic layers 17 (17*a* to 17*c*), which are insulating layers; and magnetic layers 16 (16*j* to 16*r*) in that order. As shown in FIG. 2, the stacking direction of the stack 12 is not parallel to the sides that configure the stack 12. That is, the stacking direction is not parallel to either of the x-axis direction, y-axis direction, and z-axis direction. In this embodiment, the stacking direction is orthogonal to the x-axis direction and is at an angle of 45° with respect to the y-axis direction and z-axis direction. Hence, as shown in FIGS. 1 and 2, major surfaces of the magnetic layers 16 and the non-magnetic layers 17 facing in the stacking direction are orthogonal to the side surfaces S3 and S4 and are parallel to the diagonals A1 and A3. Hereinafter, a direction parallel to the diagonals A1 and A3 is defined as α-axis direction. Also, the stacking direction is defined as β-axis direction.

As described above, since the stacking direction of the stack 12 is not parallel to either of the x-axis direction, y-axis direction, and z-axis direction, the magnetic layers 16 and the non-magnetic layers 17 have different-size rectangular shapes. More specifically, the widths in the α-axis direction of the magnetic layers 16*a* to 16*i* and the non-magnetic layers 17*a* and 17*b* increase from the positive side to the negative side in the β-axis direction. The magnetic layers 16*a* to 16*i* and the non-magnetic layers 17*a* and 17*b* have equivalent lengths in the x-axis direction. Also, the respective widths in the α-axis direction of the non-magnetic layer 17*c* and the magnetic layers 16*j* to 16*r* are decreased from the positive side to the negative side in the β-axis direction. The non-magnetic layer 17*c* and the magnetic layers 16*j* to 16*r* have equivalent lengths in the x-axis direction. Since the magnetic layers 16 and the non-magnetic layers 17 are formed as described above, the side surfaces S3 and S4 each have a square shape. In FIG. 2, the magnetic layers 16 include 18 layers. However, the number of magnetic layers 16 can be stacked by a number larger or smaller than 18.

The magnetic layers 16 are formed of, for example, a magnetic material, such as Ni—Cu—Zn ferrite. The non-magnetic layers 17 are formed of a non-magnetic material, such as Cu—Zn ferrite or glass. In the following description, a surface of each of the magnetic layers 16 and the non-magnetic layers 17 at the positive side in the β-axis direction is called front surface, and a surface of each of the magnetic layers 16 and the non-magnetic layers 17 at the negative side in the β-axis direction is called back surface.

The coil L1 is a spiral coil provided in the stack 12. Also, the coil axis of the coil L1 is substantially parallel to the stacking direction of the stack 12, i.e., the β-axis direction. Hence, the coil axis of the coil L1 is not parallel to the edges of the side surfaces that configure the stack 12.

A configuration of the coil L1 will now be described in detail. The coil L1 includes coil portions 18*a* and 18*b*, and a via-hole conductor v1. The coil portion 18*a* is a linear conductor that is provided on the front surface of the non-magnetic layer 17*b* and has a spiral form that turns clockwise toward the center. Hereinafter, an end at the outer side of the coil portion 18*a* is defined as end t1, and an end at the center side of the coil portion 18*a* is defined as end t2. The end t1 is one end of the coil L1. Hence, the coil portion 18*a* includes the one end of the coil L1. As shown in FIG. 1, the end t1 is located at the positive side in the α-axis direction with respect to an intersection P1 of the diagonals A1 and A2 in the side surface S3. The end t1 is located at the positive side in the β-axis direction slightly with respect to the diagonal A1.

Also, the coil portion 18*b* is a linear conductor that is provided on the front surface of the non-magnetic layer 17*a* and has an L shape. Hereinafter, an end at the negative side in the x-axis direction of the coil portion 18*b* is defined as end t3, and an end at the positive side in the x-axis direction of the coil portion 18*b* is defined as end t4. The end t4 is the other end of the coil L1. Hence, the coil portion 18*b* includes the other end of the coil L1. As shown in FIG. 1, the end t4 is located at the positive side in the α-axis direction with respect to an intersection P2 of the diagonals A3 and A4 in the side surface S4. The end t4 is located at the positive side in the β-axis direction slightly with respect to the diagonal A3. Also, the end t3 is aligned with the end t2 in plan view in the β-axis direction.

The via-hole conductor v1 penetrates through the non-magnetic layer 17*a* in the β-axis direction, and connects the end t2 of the coil portion 18*a* to the end t3 of the coil portion 18*b*.

The coil L2 is a spiral coil provided in the stack 12. Also, the coil axis of the coil L2 is substantially parallel to the stacking direction of the stack 12, i.e., the β-axis direction. Hence, the coil axis of the coil L2 is not parallel to the sides that configure the stack 12.

A configuration of the coil L2 is described below in detail. To be more specific, the coil L2 includes coil portions 20*a* and 20*b*, and a via-hole conductor v2. The coil portion 20*a* is a linear conductor that is provided on the front surface of the non-magnetic layer 17*c* and has a spiral form that turns clockwise toward the center. A spiral part of the coil portion 20*a* has the same shape as the shape of a spiral part of the coil portion 18*a*, and is aligned with the spiral part of the coil portion 18*a* in plan view in the β-axis direction. Hereinafter, an end at the outer side of the coil portion 20*a* is defined as end t5, and an end at the center side of the coil portion 20*a* is defined as end t6. The end t5 is one end of the coil L2. Hence, the coil portion 20*a* includes the one end of the coil L2. The end t5 is located at the negative side in the α-axis direction with respect to the intersection P1 of the diagonals A1 and A2 in the side surface S3. The end t5 is located at the negative side in the β-axis direction slightly with respect to the diagonal A1. Accordingly, the ends t1 and t5 are located to be point symmetric about the intersection P1 of the diagonals A1 and A2 in the side surface S3.

Also, the coil portion 20*b* is a linear conductor that is provided on the front surface of the magnetic layer 16*j* and has an L shape. Hereinafter, an end at the negative side in the x-axis direction of the coil portion 20*b* is defined as end t7, and an end at the positive side in the x-axis direction of the coil portion 20*b* is defined as end t8. The end t8 is the other end of the coil L2. Hence, the coil portion 20*b* includes the other end of the coil L2. The end t8 is located at the negative side in the α-axis direction with respect to the intersection P2 of the diagonals A3 and A4 in the side surface S3. The end t8 is located at the negative side in the β-axis direction slightly with respect to the diagonal A3. Accordingly, the ends t4 and t8 are located to be point symmetric about the intersection P2 of the diagonals A3 and A4 in the side surface S4. Also, the end t7 is aligned with the end t6 in plan view in the β-axis direction.

The via-hole conductor v2 penetrates through the magnetic layer 17*c* in the β-axis direction, and connects the end t6 of the coil portion 20*a* to the end t7 of the coil portion 20*b*.

As described above, the coil L1 is provided on the front surfaces of the non-magnetic layers 17*a* and 17*b*, and the coil L2 is provided on the front surfaces of the non-magnetic layer 17*c* and the magnetic layer 16*j*. Hence, the coils L1 and L2 face each other with the diagonal A1 of the side surface S3 interposed therebetween when viewed in the direction of the normal to the side surface S3, i.e., in the x-axis direction. Accordingly, the coils L1 and L2 are electromagnetically coupled with each other, and form a common mode choke coil.

The outer electrodes 14*a* and 14*b* are provided on the side surface S3 of the stack 12, and are connected to the ends t1 and t5, respectively. To be more specific, the outer electrodes 14*a* and 14*b* extend in the z-axis direction in the side surface S3 of the stack 12. The outer electrode 14*a* is provided at the negative side in the y-axis direction as compared with the outer electrode 14*b*. The ends t1 and t5 are covered with the outer electrodes 14*a* and 14*b*, respectively. Also, each of the outer electrodes 14*a* and 14*b* is folded back to the upper surface S1 and the lower surface S2.

The outer electrodes 14*c* and 14*d* are provided on the side surface S4 of the stack 12, and are connected to the ends t4 and t8, respectively. To be more specific, the outer electrodes 14*c* and 14*d* extend in the z-axis direction in the side surface S4 of the stack 12. The outer electrode 14*c* is provided at the negative side in the y-axis direction as compared with the outer electrode 14*d*. The ends t4 and t8 are covered with the outer electrodes 14*c* and 14*d*, respectively. Also, each of the outer electrodes 14*c* and 14*d* is folded back to the upper surface S1 and the lower surface S2.

In the electronic component 10 configured as described above, the coils L1 and L2 are aligned with each other in plan view in the β-axis direction. Hence, a magnetic flux generated by the coil L1 passes through the coil L2, and a magnetic flux generated by the coil L2 passes through the coil L1. Accordingly, the coil L1 and the coil L2 are magnetically coupled with each other, and the coil portion 20*a* and the coil portion 20*b* configure a common mode choke coil. The outer electrodes 14*a* and 14*b* are used as input terminals, and the outer electrodes 14*c* and 14*d* are used as output terminals. In particular, a differential transmission signal is input to the outer electrodes 14*a* and 14*b*, and is output from the outer electrodes 14*c* and 14*d*. If the differential transmission signal includes a common mode noise, the coils L1 and L2 generate magnetic fluxes in the same direction because of the common mode noise. Owing to this, the magnetic fluxes enhance each other, and impedance for the common mode is generated. As the result, the common mode noise is converted into heat, and the signal is interrupted from passing through the coils L1 and L2.

Figure 3A:
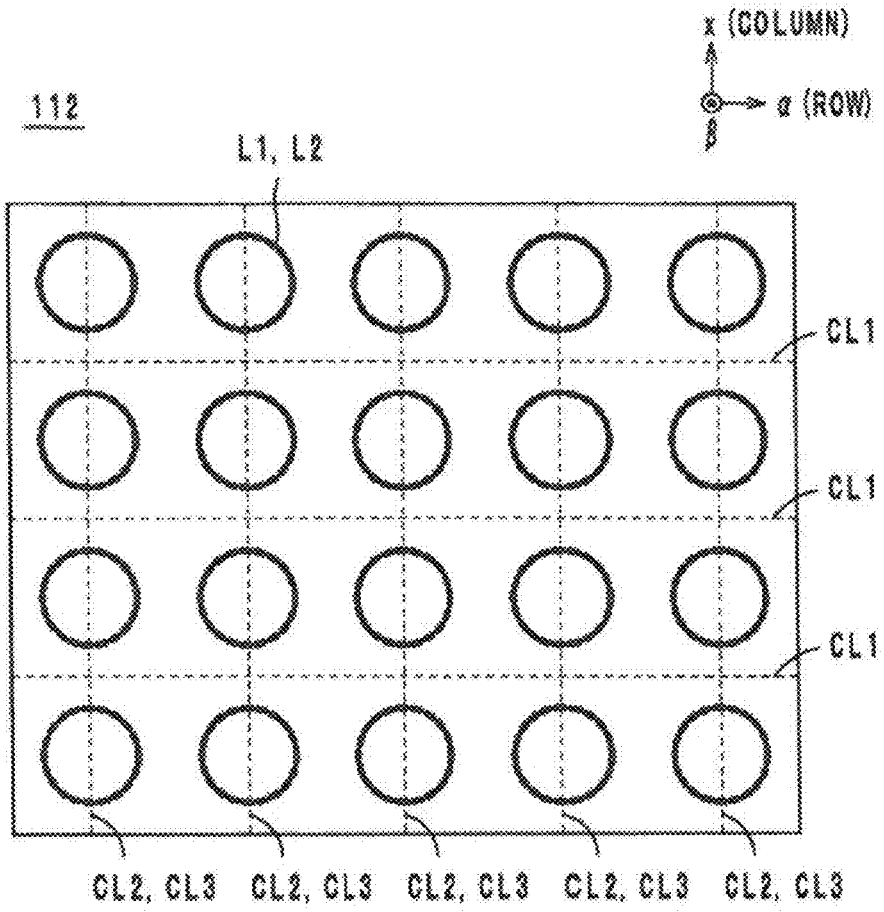
FIGS. 3A and 3B illustrate an exemplary mother stack.
Figure 3B:
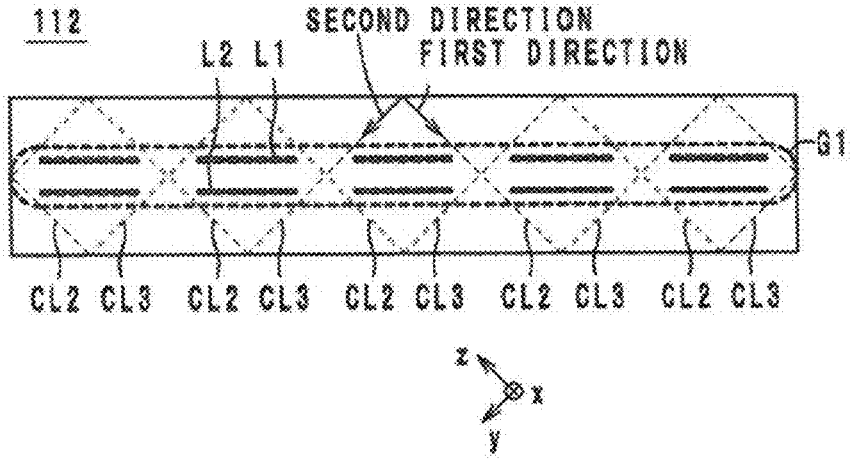

An exemplary manufacturing method of the electronic component 10 configured as described above will now be described with reference to the drawings. FIGS. 3A and 3B illustrate a mother stack 112.

First, ceramic green sheets (mother insulating layers), which become the magnetic layers 16 and the non-magnetic layers 17, are fabricated. The ceramic green sheets each have a large rectangular shape. A fabricating step of the respective ceramic green sheets, which become the magnetic layers 16 and the non-magnetic layers 17, is a well-known step, and hence further description is not provided.

Then, via holes are formed in the respective ceramic green sheets, which become the non-magnetic layers 17*a* and 17*c*, by irradiating formation positions of the via-hole conductors v1 and v2 with a laser beam. Further, the via-hole conductors v1 and v2 are formed by filling the via holes with conductive paste. The conductive paste has a conductor such as Ag as a principal component.

Then, the coil portions 18*a*, 18*b*, 20*a*, and 20*b* shown in FIG. 2 are formed on the front surfaces of the respective ceramic green sheets, which become the non-magnetic layers 17*b*, 17*a*, and 17*c*, and the magnetic layer 16*j*, by screen-printing conductive paste having a conductor such as Ag as a principal component. At this time, as shown in FIG. 3A, the coil portions 18*a*, 18*b*, 20*a*, and 20*b* (the coils L1 and L2) are formed in rows and columns in which a row direction (the α-axis direction) is orthogonal to a column direction (the x-axis direction). Alternatively, the via holes may be filled with the conductive paste simultaneously with the formation of the coil portions 18*a*, 18*b*, 20*a*, and 20*b*.

Then, the respective ceramic green sheets, which become the magnetic layers 16*a* to 16*i*, the non-magnetic layers 17*a* to 17*c*, and the magnetic layers 16*j* to 16*r*, are stacked and press-bonded in that order from the positive side to the negative side in the β-axis direction. Accordingly, as shown in FIGS. 3A and 3B, the mother stack 112 embedded with a coil group G1 including a plurality of sets of the coils L1 and L2 arranged in the rows and columns is formed.

Then, the mother stack 112 is cut in an area between the rows of the plurality of sets of coils L1 and L2 along the row direction, in a direction orthogonal to the principal plane of the mother stack 112. That is, the mother stack 112 is cut by arranging a dicer to be orthogonal to the principal plane of the mother stack 112 and by moving the dicer along a cut line CL1 shown in FIG. 3A.

Then, the mother stack 112 is cut in an area between the columns of the plurality of sets of coils L1 and L2 along the column direction, in a first direction inclined to the principal plane of the mother stack 112 by 45° (see FIG. 3B). The first direction is a direction to the negative side in the z-axis direction. That is, the mother stack 112 is cut by directing the dicer to the negative side in the z-axis direction and by moving the dicer along a cut line CL2 shown in FIG. 3A. The dicer passes through an intermediate point between the adjacent sets of coils L1 and L2 as shown in FIG. 3B.

Then, the mother stack 112 is cut in an area between the columns of the plurality of sets of coils L1 and L2 along the row direction, in a second direction orthogonal to the first direction (see FIG. 3B). The second direction is a direction to the positive side in the y-axis direction. That is, the mother stack 112 is cut by directing the dicer to the positive side in the y-axis direction and by moving the dicer along a cut line CL3 shown in FIG. 3A. The dicer passes through an intermediate point between the adjacent sets of coils L1 and L2 as shown in FIG. 3B. Accordingly, the mother stack 112 is divided into a plurality of unfired stacks 12.

Then, binder removing processing and firing are performed on the unfired stacks 12. Then, barrel polishing processing is performed on the front surfaces of the stacks 12 for chamfering.

Then, electrode paste, which is made of a conductive material having a conductor such as Ag as a principal component, is applied on the side surfaces S3 and S4, the upper surface S1, and the lower surface S2 of each of the stacks 12, and the applied electrode paste is baked. Accordingly, respective silver electrodes, which become the outer electrodes 14, are formed. Further, the front surfaces of the respective silver electrodes, which become the outer electrodes 14, are treated with Ni plating/Sn plating. Thus, the outer electrodes 14 are formed. With the above-described steps, the electronic component 10 is completed.

With the electronic component 10 configured as described above, the diameter of the coils L1 and L2 can be increased without an increase in element size. To be more specific, with the electronic component 10, the stacking direction of the stack 12 and the coil axes of the coils L1 and L2 are not parallel to the sides that configure the stack 12. In this embodiment, in particular, the plurality of magnetic layers 16 and non-magnetic layers 17 are orthogonal to the side surface S3 of the stack 12. Accordingly, the area of the non-magnetic layer 17 near the center in the stacking direction (in the β-axis direction) is larger than the area of the upper surface S1. Hence, with the electronic component 10, the diameter of the coils L1 and L2 can be increased without an increase in element size. Further, with the electronic component 10, the number of turns of each of the coils L1 and L2 can be increased.

Further, the magnetic layers 16 and the non-magnetic layers 17 are parallel to the diagonal A1 of the side surface S3. At this time, the area of the non-magnetic layer 17 near the center in the stacking direction (the β-axis direction) is the maximum. Hence, with the electronic component 10, the diameter of the coils L1 and L2 can be further increased without an increase in element size. Further, with the electronic component 10, the number of turns of each of the coils L1 and L2 can be further increased.

Figure 4:
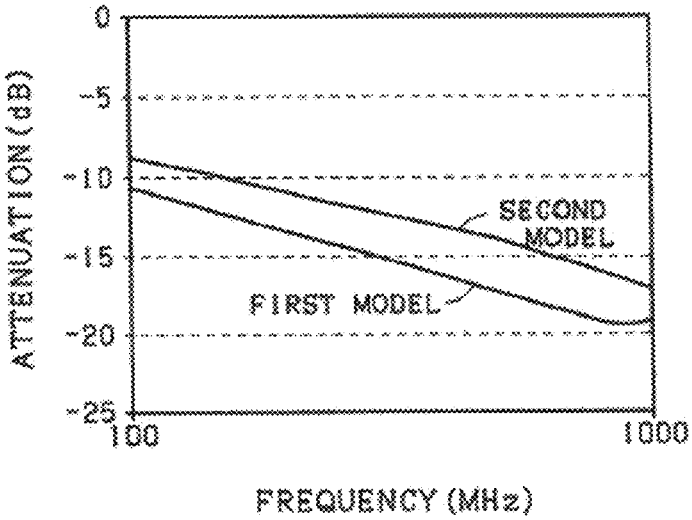
FIG. 4 is a graph showing the result of computer simulation.

The inventor of the subject application performed computer simulation (described below) in order to clarify effects attained by the electronic component 10. In particular, a first model corresponding to the electronic component 10 according to this embodiment, and a second model corresponding to an electronic component according to a comparative example were fabricated. The second model has the same size as the first model, and is a model in which magnetic layers and non-magnetic layers are stacked in the z-axis direction. Then, for each of the first model and the second model, an attenuation of a signal output from the outer electrode 14*c* with respect to a signal input to the outer electrode 14*a* was calculated. FIG. 4 is a graph showing the result of the computer simulation. The vertical axis plots the attenuation and the horizontal axis plots the frequency.

Referring to FIG. 4, it is found that the attenuation of the first model is larger than the attenuation of the second model. This represents that the first model has a better noise removing property than the second model because the number of turns of a coil in the first model was increased by one turn as compared with the number of turns of a coil in the second model.

Figure 5A:
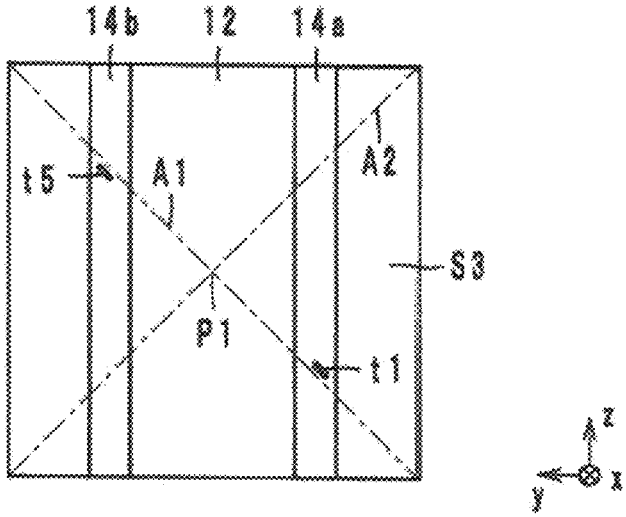
FIGS. 5A and 5B illustrate the electronic component shown in FIG. 1 in plan view from the negative side in an x-axis direction.
Figure 5B:
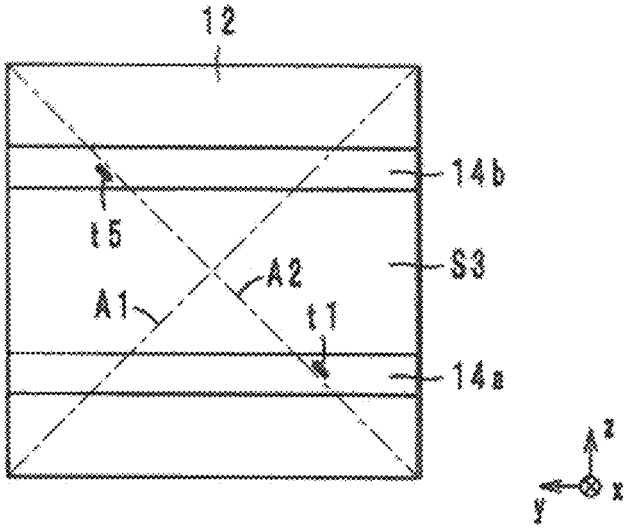

Also, with the electronic component 10, formation of the outer electrodes 14*a* to 14*d* is facilitated as described below. FIG. 5A illustrates the electronic component 10 shown in FIG. 1 in plan view from the negative side in the x-axis direction, and FIG. 5B illustrates the alternative electrode configuration in plan view from the negative side in the x-axis direction.

As shown in FIG. 1, the side surface S3 of the electronic component 10 has a square shape, and the end t1 of the coil L1 and the end t2 of the coil L2 are located to be point symmetric about the intersection P1 of the diagonals A1 and A2. Thus, as shown in FIG. 5A, the outer electrodes 14*a* and 14*b* may be formed to extend in the z-axis direction. Alternatively, as shown in FIG. 5B, the outer electrodes 14*a* and 14*b* may be formed to extend in the y-axis direction. That is, with the electronic component 10, the direction of the stack 12 does not have to be identified when the outer electrodes 14*a* to 14*d* are formed. Also, in the electronic component 10, the direction of the stack 12 does not have to be aligned when the outer electrodes 14*a* to 14*d* are formed. In this way, with the electronic component 10, the formation of the outer electrodes 14*a* to 14*d* is facilitated.

An electronic component and a manufacturing method thereof according to the present disclosure are not limited to the electronic component 10 and the manufacturing method thereof described in the embodiment, and the electronic component 10 and the manufacturing method thereof may be changed within the scope of the present disclosure.

Figure 6:
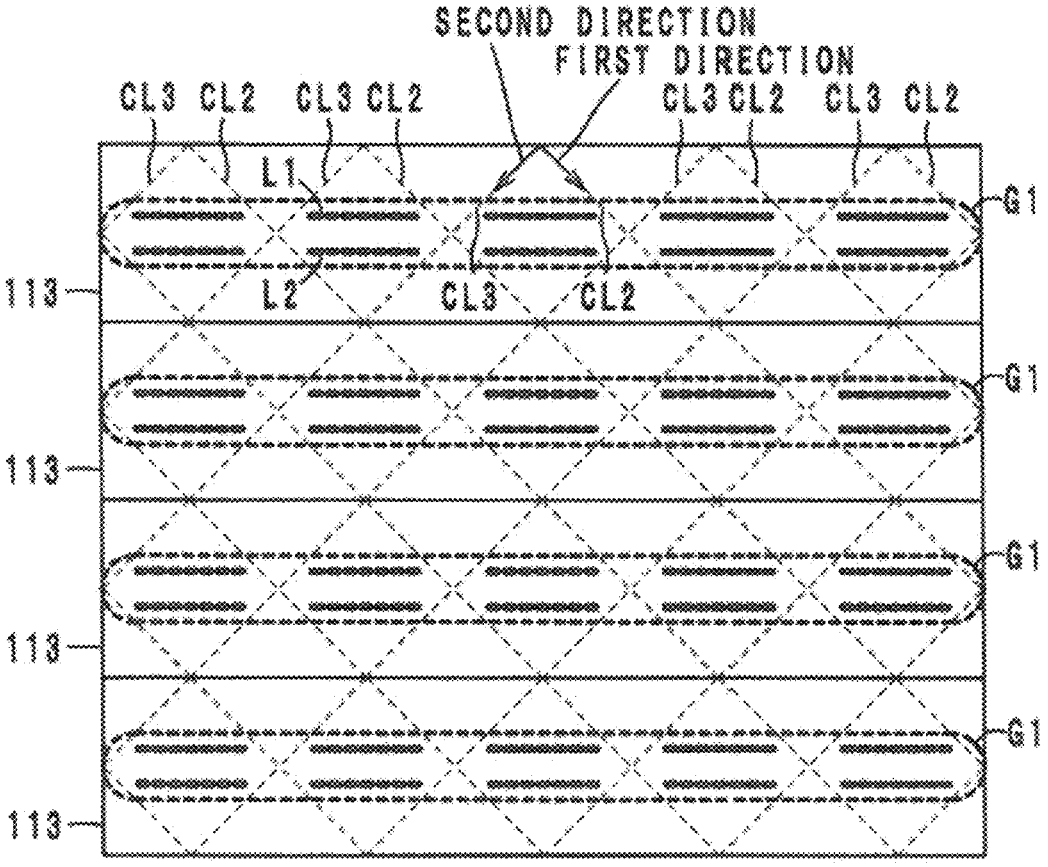
FIG. 6 is a process chart by a manufacturing method according to another exemplary embodiment.

In the manufacturing method of the electronic component 10, the mother stack 112 is cut while the dicer is inclined. However, with the following exemplary manufacturing method of the electronic component 10, the mother stack 112 can be cut while the dicer is not inclined. FIG. 6 is a process chart by a manufacturing method according to another exemplary embodiment.

With the manufacturing method according to this embodiment, a stack group 113 for a single row cut along a cut line CL1 is rotated about the α-axis by 90° as shown in FIG. 6. Hence, a side surface S3 of the stack group 113 faces the upper side.

Then, a plurality of the stack groups 113 are arranged in line in the x-axis direction.

Then, the stack groups 113 are cut along a cut line CL2 in a direction orthogonal to the side surface S3. Further, the stack groups 113 are cut along a cut line CL3 in a direction orthogonal to the side surface S3. Accordingly, the mother stack 112 is divided into a plurality of stacks 12.

While the electronic component 10 uses the magnetic layers 16 and the non-magnetic layers 17, the magnetic layers 16 may not be used. In this case, the electronic component 10 can be efficiently manufactured by the following manufacturing method.

Figure 7A:
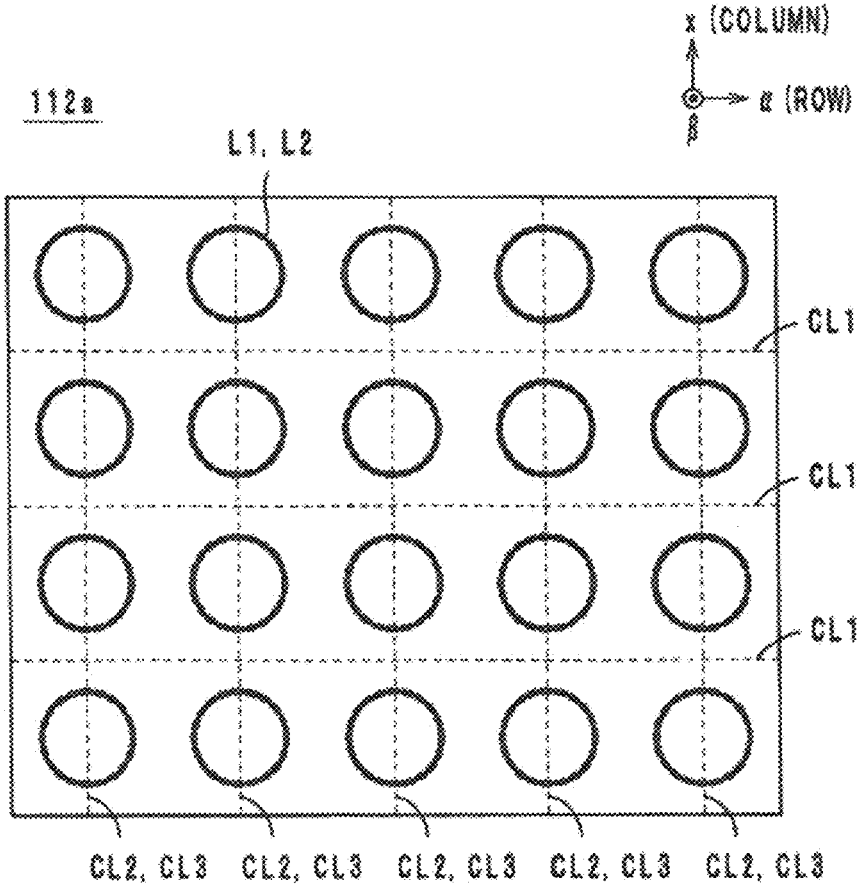
FIGS. 7A and 7B illustrate an exemplary mother stack.
Figure 7B:
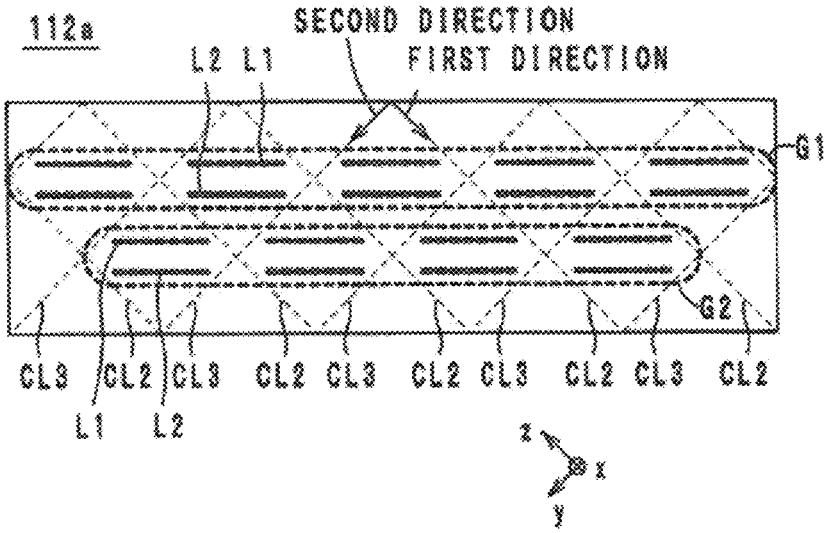

Hereinafter, a manufacturing method of an electronic component 10 according to still another exemplary embodiment will now be described with reference to the drawings. FIGS. 7A and 7B illustrate a mother stack 112*a*.

First, respective ceramic green sheets, which become non-magnetic layers 17 and 117 (see FIG. 2), are fabricated. The ceramic green sheets each have a large rectangular shape. A fabricating step of the respective ceramic green sheets, which become the non-magnetic layers 17 and 117, is a well-known step, and hence the description thereof is not provided.

Then, via holes are formed in the respective ceramic green sheets, which become the non-magnetic layers 17*a* and 17*c*, by irradiating formation positions of the via-hole conductors v1 and v2 with a laser beam. Further, the via-hole conductors v1 and v2 are formed by filling the via holes with conductive paste. The conductive paste has a conductor such as Ag as a principal component.

Then, the coil portions 18*a*, 18*b*, 20*a*, and 20*b* shown in FIG. 2 are formed on the front surfaces of the respective ceramic green sheets, which become the non-magnetic layers 17*a*, 17*b*, 17*c*, and 117*j*, by screen-printing conductive paste having a conductor such as Ag as a principal component. At this time, as shown in FIG. 7A, the coil portions 18*a*, 18*b*, 20*a*, and 20*b* (the coils L1 and L2) are formed in the rows and columns in which the row direction (the α-axis direction) is orthogonal to the column direction (the x-axis direction). Alternatively, the via holes may be filled with the conductive paste simultaneously with formation of the coil portions 18*a*, 18*b*, 20*a*, and 20*b*.

Then, the respective ceramic green sheets, which become the non-magnetic layers 117*a* to 117*i*, 17*a* to 17*c*, and 117*j* to 117*r*, are stacked and press-bonded in that order from the positive side to the negative side in the β-axis direction. At this time, as shown in FIGS. 7A and 7B, the respective ceramic green sheets, which become the non-magnetic layers 117*a* to 117*i*, 17*a* to 17*c*, and 117*j* to 117*r*, are stacked such that a coil group G2 including a plurality of sets of the coils L1 and L2 arranged in rows and columns is arranged at the lower side of the coil group G1 in the stacking direction at the negative side in the β-axis direction. At this time, the ceramic green sheets are stacked so that the coils L1 and L2 that form the coil group G2 are located in the first direction with respect to the coils L1 and L2 that form the coil group G1. Accordingly, the mother stack 112*a* embedded with the coil groups G1 and G2 is formed.

Then, the mother stack 112*a* is cut in an area between the rows of the plurality of sets of coils L1 and L2 along the row direction, in a direction orthogonal to the principal plane of the mother stack 112*a*. That is, the mother stack 112*a* is cut by arranging a dicer to be orthogonal to the principal plane of the mother stack 112*a* and by moving the dicer along a cut line CL1 shown in FIG. 7A.

Then, the mother stack 112*a* is cut in an area between the columns of the plurality of sets of coils L1 and L2 along the column direction, in a first direction inclined to the principal plane of the mother stack 112*a* by 45° (see FIG. 7B). The first direction is a direction to the negative side in the z-axis direction. That is, the mother stack 112*a* is cut by directing the dicer to the negative side in the z-axis direction and by moving the dicer along a cut line CL2 shown in FIG. 7A. The dicer passes through an intermediate point between the adjacent sets of coils L1 and L2 as shown in FIG. 7B.

Then, the mother stack 112*a* is cut in an area between the columns of the plurality of sets of coils L1 and L2 along the row direction, in a second direction orthogonal to the first direction (see FIG. 7B). The second direction is a direction to the positive side in the y-axis direction. That is, the mother stack 112*a* is cut by directing the dicer to the positive side in the y-axis direction and by moving the dicer along a cut line CL3 shown in FIG. 7A. The dicer passes through an intermediate point between the adjacent sets of coils L1 and L2 as shown in FIG. 7B. Accordingly, the mother stack 112*a* is divided into a plurality of unfired stacks 12.

Then, barrel polishing processing is performed on the front surfaces of the unfired stacks 12 for chamfering. Then, binder removing processing and firing are performed on the unfired stacks 12.

Then, electrode paste, which is made of a conductive material having a conductor such as Ag, as a principal component, is applied on the side surfaces S3 and S4, the upper surface S1, and the lower surface S2 of each of the stacks 12, and the applied electrode paste is baked. Accordingly, respective silver electrodes, which become the outer electrodes 14, are formed. Further, the front surfaces of the respective silver electrodes, which become the outer electrodes 14, are treated with Ni plating/Sn plating. Thus, the outer electrodes 14 are formed. With the above-described steps, the electronic component 10 is completed.

With the above-described exemplary manufacturing method of manufacturing the electronic component 10, an unused region in the mother stack 112 in FIGS. 3A and 3B is used. Thus, the electronic component 10 can be efficiently manufactured. If the number of coil groups is increased, the electronic component 10 can be further efficiently manufactured.

Alternatively, the stack 12 may be entirely fabricated by magnetic layers.

As described above, embodiments according to the present disclosure are useful for an electronic component and a manufacturing method thereof. In particular, embodiments according to the present disclosure are excellent in that the diameter of a coil can be increased without an increase in element size.

What is claimed is:

1. An electronic component, comprising:

a rectangular-parallelepiped stack configured by stacking a plurality of insulating layers; and a first coil in the stack having a coil axis substantially parallel to a stacking direction of the stack, wherein the stacking direction and the coil axis are not parallel to respective edges that configure the stack, each respective major surface of the plurality of insulating layers is orthogonal to a first side surface of the stack, and the major surfaces of the plurality of insulating layers are parallel to a first diagonal of the first side surface.

2. The electronic component according to claim 1, wherein the first side surface has a square shape.

3. The electronic component according to claim 2, further comprising:

a second coil provided in the stack and having a coil axis substantially parallel to the stacking direction of the stack.

4. The electronic component according to claim 3, wherein the first coil and the second coil configure a common mode choke coil such that the first coil and the second coil face each other with the first diagonal of the first side surface interposed therebetween in plan view in a direction of the normal to the first side surface.

5. The electronic component according to claim 3, wherein one end of the first coil and one end of the second coil are located to be point symmetric about an intersection of the first diagonal and a second diagonal at the first side surface.

6. The electronic component according to claim 5, wherein the electronic component further comprises a first outer electrode and a second outer electrode that are provided on the first side surface and are connected to the one end of the first coil and the one end of the second coil, respectively.

7. The electronic component according to claim 4, wherein the first coil and the second coil are spiral.

8. The electronic component according to claim 6, wherein the first coil and the second coil are spiral.

9. The electronic component according to claim 7, wherein the first coil includes a first coil portion having the one end of the first coil and being spiral, a second coil portion having the other end of the first coil, and a via-hole conductor that connects an end at a center side of the first coil portion to the second coil portion, wherein the other end of the first coil is located at the second side surface that is opposed to the first side surface.

10. The electronic component according to claim 8, wherein the first coil includes a first coil portion having the one end of the first coil and being spiral, a second coil portion having the other end of the first coil, and a via-hole conductor that connects an end at a center side of the first coil portion to the second coil portion, wherein the other end of the first coil is located at the second side surface that is opposed to the first side surface.

11. A manufacturing method of the electronic component according to claim 1, the method comprising steps of:

fabricating a mother stack that is configured by stacking a plurality of mother insulating layers and is embedded with a first coil group including a plurality of first coils arranged in rows and columns in which a row direction is orthogonal to a column direction;

cutting the mother stack in an area between the rows of the plurality of first coils along the row direction, in a direction orthogonal to a principal plane of the mother stack;

cutting the mother stack in an area between the columns of the plurality of first coils along the column direction, in a first direction inclined with respect to the principal plane of the mother stack; and cutting the mother stack in an area between the columns of the plurality of first coils along the column direction, in a second direction orthogonal to the first direction.

12. The manufacturing method according to claim 11 of the electronic component, wherein a second coil group is, in the first step, formed in the mother stack, the second coil group including the plurality of first coils arranged in the rows and columns in which the row direction is orthogonal to the column direction, the second coil group being formed at a lower side in the stacking direction with respect to the first coil group, and wherein the first coils included in the second coil group are located in the first direction with respect to the first coils included in the first coil group.

* * * * *